US006190180B1

(12) United States Patent
Purington et al.

(10) Patent No.: US 6,190,180 B1
(45) **Date of Patent: *Feb. 20, 2001**

(54) SWIVELING ELECTRICAL CONNECTOR

(76) Inventors: Kim Purington, 245 Keaniani Pl., Kailua, HI (US) 96734; Jeffrey Powers, 807-20th Ave., Honolulu, HI (US) 96816; Robert J. Wright, 307 Leeann La., Leucadia, CA (US) 92024

( * ) Notice: Under 35 U.S.C. 154(b), the term of this patent shall be extended for 0 days.

This patent is subject to a terminal disclaimer.

(21) Appl. No.: 09/315,882

(22) Filed: May 20, 1999

Related U.S. Application Data

(60) Continuation-in-part of application No. 08/637,001, filed on Apr. 18, 1996, now Pat. No. 5,803,750, which is a division of application No. 09/064,016, filed on Apr. 20, 1998.

(51) Int. Cl.[7] ..... H01R 39/00
(52) U.S. Cl. ..... 439/17; 439/700
(58) Field of Search ..... 439/17, 345, 346, 439/347, 348, 349, 13, 11

(56) References Cited

U.S. PATENT DOCUMENTS

| | | | |
|---|---|---|---|
| 1,174,379 | 3/1916 | Bacon . | |
| 2,176,137 | 10/1939 | Jurkat | 173/324 |
| 2,181,145 | 11/1939 | Mose | 173/324 |
| 2,465,022 | 3/1949 | Laubi | 173/324 |
| 2,474,070 | 6/1949 | Sokolik | 173/324 |
| 2,764,746 | 9/1956 | Terlinde | 339/8 |
| 2,941,177 | 6/1960 | Merritt | 339/8 |
| 3,321,729 | 5/1967 | Phillips | 339/8 |
| 3,387,250 | 6/1968 | Bjorn et al. | 339/8 |
| 3,629,784 | 12/1971 | Bjorn et al. | 339/8 |
| 4,472,010 | 9/1984 | Parnello | 339/8 R |
| 4,583,798 | 4/1986 | Blazowich | 339/8 P |
| 4,753,600 | 6/1988 | Williams | 439/22 |
| 4,804,329 | 2/1989 | Nakayama et al. | 439/20 |
| 4,894,014 | 1/1990 | Palus et al. | 439/17 |
| 5,114,361 | 5/1992 | Houtteman | 439/348 |
| 5,803,750 * | 9/1998 | Purington et al. | 439/17 |

FOREIGN PATENT DOCUMENTS

| | | |
|---|---|---|
| 1539119 | 9/1968 | (FR) . |
| 700847 | 1/1966 | (IT) . |

OTHER PUBLICATIONS

Supplementary European Search Report dated May 5, 1999.

* cited by examiner

*Primary Examiner*—Neil Abrams
*Assistant Examiner*—Eugene G. Byrd
(74) *Attorney, Agent, or Firm*—Beyer Weaver & Thomas LLP

(57) ABSTRACT

A swiveling electrical connector is described. A male assembly has three conductors electrically isolated from each other. A first one of the three conductors in the male assembly includes a cylindrical surface. A female assembly has three conductors electrically isolated from each other and a receptacle for receiving the male assembly. A first one of the three conductors in the female assembly has a clip assembly extending therefrom for contacting the cylindrical surface of the first conductor in the male assembly. A locking mechanism is coupled to the female assembly for locking the male and female assemblies together when the male assembly is inserted into the female assembly thereby providing electrical contact between the male assembly conductors and the female assembly conductors. The male and female assemblies rotate relative to each other when locked together, the clip assembly in the female assembly maintaining contact with the first conductor in the male assembly while the male and female assemblies rotate relative to each other.

9 Claims, 7 Drawing Sheets

SWIVELING ELECTRICAL CONNECTOR

RELATED APPLICATION DATA

The present application is a Continuation-in-Part of U.S. application Ser. No. 08/637,001 filed on Apr. 18, 1996, which issued on Sep. 8, 1998, as U.S. Pat. No. 5,803,750; which is a division of U.S. application Ser. No. 09/064,016 filed on Apr. 20, 1998, the entirety of which is incorporated herein by reference for all purposes.

BACKGROUND OF THE INVENTION

The present application relates to a swiveling electrical connector. More specifically, the present application describes an electrical connector having two assemblies which freely rotate relative to each other and which may be quickly connected and disconnected.

The use of electrical power tools on building construction sites necessitates the reliable distribution of high-current electrical power throughout the often chaotic and obstacle-laden environment which such sites represent. Typically, power is distributed on such sites through the use of conventional electrical extension cords which are terminated with fixed, three-prong plugs and receptacles. As is well known to construction workers, such fixed connectors present a variety of practical problems. For example, the nature of construction work is such that the worker often must move over a considerable area and maneuver himself in close quarters while using the same power tool. Under such conditions, fixed connectors tend to twist and knot creating hazardous conditions as well as causing considerable wear and tear on the respective power cords. Moreover, as fixed connectors are dragged through the construction site, they tend to snag on comers and other obstacles resulting in disconnection due to the tension on the power cord which, in turn, results in a reduction in the efficiency of the worker as he scrambles to reconnect the line or free up a snag. To prevent such disconnections, workers typically knot the cords together near the connection. However, this merely tends to exacerbate the problems related to cord wear and snagging.

Other problems relate to the fact that construction workers typically use a variety of different power tools in a single work area. In general, power tools have power cords built into their handles which are several feet long and which are terminated with fixed three-prong plugs. When switching power tools, the worker must reach the connection, disconnect the current power tool, connect the new power tool, and store the disconnected power tool. If the worker is in a precarious position such an operation is difficult at best. That is, the connection may be several feet away and out of reach unless the worker extricates himself from his working position. In addition, the built in cords of the power tools present handling and storage problems which are often difficult to deal with under practical conditions.

Attempts have been made to address some of the problems discussed above with swiveling electrical connectors. However, none of these connectors provides features which address all of these problems. For example, U.S. Pat. No. 1,174,379, No. 2,176,137, No. 2,181,145, No. 2,465,022, No. 2,474,070, No. 3,387,250, and No. 4,894,014 all describe various electrical connectors each of which has two assemblies which rotate relative to each other. However, none of these designs is appropriate for use in the construction environment in that they provide for connection between electrical cords having only two conductors. Because of the additional complexity represented by a third conductor, none of the designs described in these patent could be readily converted to provide a rotatable connection for three conductors. Moreover, all of these connectors maintain permanent connections between the two assemblies. While this may prevent disconnection problems, it fails to address the problems discussed above with regard to the interchangeability of power tools.

The rotatable connector described by U.S. Pat. No. 3,321,729 has two permanently connected assemblies 12 and 50 which rotate relative to each other. While this design allows connection and disconnection from separate power cords via prongs 38, 40 and receptacles 64, 66, it does not address the problem of cord disconnection due to tension. In addition, the power cords connected by this device have only two conductors.

U.S. Pat. No. 3,629,784 describes a three-conductor swivel connection which is permanently fixed in the handle of a power tool. While this design may alleviate some of the problems related to the twisting and knotting of power tool power cords, it does not address the problems associated with the need to quickly and efficiently switch between power tools. Moreover, because a connection must still be made between the other end of the tool's power cord and an extension cord (presumably using the conventional three-prong plug and receptacle), all of the hazards associated with such a connection are still present.

From the foregoing, it is apparent that there is a need for a swiveling electrical connector which provides a connection between power cords having three conductors, maintains the connection even under considerable tension, and is quickly and easily connected and disconnected.

SUMMARY OF THE INVENTION

The present invention provides a swiveling electrical connector which addresses each of the problems discussed above. Specifically, the present invention provides a connector for triple-conductor power cords comprising male and female coupling assemblies which rotate relative to each other when connected. The connector of the present invention is a plunger-type connector in which an elongated male assembly is inserted into an open female assembly. Each of the assemblies has three concentrically arranged conductors separated by concentrically arranged insulating layers. Each conductor is in electrical contact with its corresponding conductor in the other assembly when the assemblies are connected.

The connection between the assemblies is secured by a locking mechanism similar to the type employed for pneumatic hose connections. That is, a spring-loaded, slidable collar on the female assembly is employed in a first position to secure a ring of ball bearings in an annular groove around a portion of the male assembly, thereby locking the assemblies together; and in a second position to allow the ball bearings to retract from the groove, thereby allowing the assemblies to be disconnected. This "quick-release" locking mechanism allows the assemblies to be readily connected and disconnected.

According to specific embodiments of the invention, each of the male and female assemblies are at least partially enclosed in a non-conductive sleeve which, when the assemblies are connected, combine with the collar mechanism to form a sleek, streamlined profile resistive to snagging on edges and corners by which the power cord and connector may be dragged. According to more specific embodiments, the non-conductive sleeves are threaded on their inner surfaces and engage corresponding threads on the exteriors of the male and female assemblies. In this way, the sleeves may be retracted from the assemblies if desired.

According to other specific embodiments, a male assembly designed according to the invention is the terminus of a short power cord which is permanently affixed to a power tool handle. The male assembly is for connection to an extension cord having a corresponding female assembly. Such embodiments are particularly useful in environments where power tools are frequently interchanged. Not only does the present invention facilitate easy connection and disconnection, the power tools are more easily stored without a cumbersome power cord. In a mass production environment, a single power cord terminated with a female assembly is provided for each work station on a retracting roller system. A number of power tools having the male assembly termination is also provided at each of the work stations. In a home environment, the fastidious do-it-yourself enthusiast can add one more level of organization to his workshop.

According to still other embodiments, one or both of the male and female assemblies are terminated with a conventional three-prong plug or receptacle to provide a variety of connection options for conventional extension cords, plugs and sockets.

The various embodiments of the invention provide several obvious advantages over conventional extension cords and connectors, as well as previous swiveling connector designs. For example, as discussed above, the swiveling nature of the connection reduces power cord wear and knotting. Also as discussed above, the connection assemblies of the invention are readily interchanged providing a high degree of flexibility and efficiency in a variety of work environments. The sleek profile prevents undesirable snagging, cord tension and resulting disconnection. The locking mechanism provides an additional safeguard against inadvertent disconnection while also providing a mechanical connection capable of supporting a considerable amount of weight. The value of this feature is obvious to anyone who has dropped a tool while roofing, or lost his balance on a scaffolding.

In addition to these advantages, embodiments of the present invention may be adapted to carry a wide range of amperage for both home and industrial use. Moreover, the manner in which the conductors are enclosed prevents shorting from external sources such as, for example, children and foreign objects. Likewise, the insulation between the conductors in the connection assemblies, and the configuration of the assemblies themselves are designed to prevent internal arcing.

Thus, according to the present invention an electrical connector is provided. A male assembly has three conductors electrically isolated from each other. A first one of the three conductors in the male assembly includes a cylindrical surface. A female assembly has three conductors electrically isolated from each other and a receptacle for receiving the male assembly. A first one of the three conductors in the female assembly has a clip assembly extending therefrom for contacting the cylindrical surface of the first conductor in the male assembly. A locking mechanism is coupled to the female assembly for locking the male and female assemblies together when the male assembly is inserted into the female assembly thereby providing electrical contact between the male assembly conductors and the female assembly conductors. The male and female assemblies rotate relative to each other when locked together, the clip assembly in the female assembly maintaining contact with the first conductor in the male assembly while the male and female assemblies rotate relative to each other.

A further understanding of the nature and advantages of the present invention may be realized by reference to the remaining portions of the specification and the drawings.

DESCRIPTION OF THE PREFERRED EMBODIMENT

The following is a description of a specific embodiment of the present invention.

First, each of the features of the female and male assemblies is identified. Then the interaction of the assemblies is discussed. Features which are shown in more than one drawing retain the same reference designation throughout the drawings.

Figure 1A:
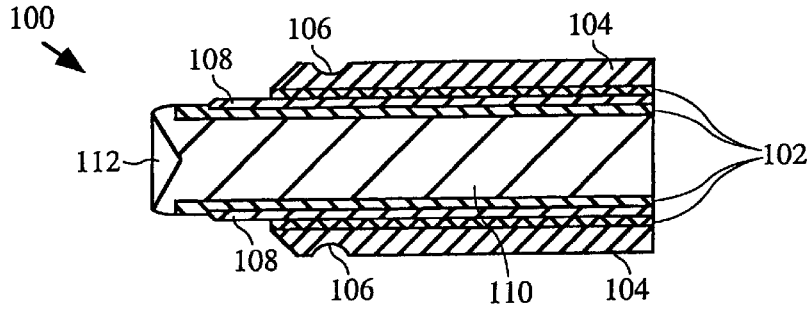
FIG. 1A is a cut-away side view of a male assembly designed according to a specific embodiment of the invention.

FIG. 1A is a cut-away side view of a male assembly 100 designed according to a specific embodiment of the invention. Male assembly 100 has three cylindrical, concentrically arranged conductors separated by insulation material 102. Ground conductor 104, the outermost of the conductors, connects with the ground wire of the power cord to which male assembly 100 is connected (not shown). Ground conductor 104 is characterized by an annular depression 106 around its exterior. The middle cylindrical conductor is a neutral conductor 108 which connects to the power cord's neutral line. Line conductor 110 connects with the line conductor of the power cord, conducting the line current to and from the female assembly shown in FIG. 1B. Line conductor 110 is characterized at one end by a cone-shaped divet or receptacle 112.

Figure 1B:
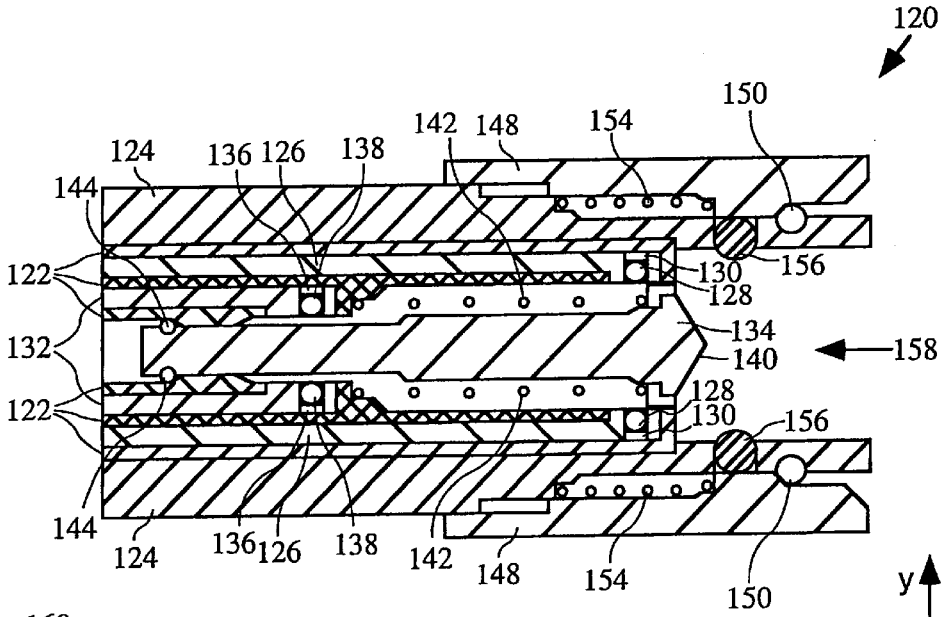
FIG. 1B is a cut-away side view of a female assembly designed according to a specific embodiment of the invention.

FIG. 1B is a cut-away side view of a female assembly 120 for connection to male assembly 100 of FIG. 1A. Female assembly 120 also has three cylindrical, concentrically arranged conductors which are separated by insulation material 122. Ground conductor 124, the outermost of the conductors, connects with the ground wire of the power cord to which female assembly 120 is connected (not shown). Neutral conductor 126, the middle conductor, connects to the power cord's neutral line and to neutral conductor 108 of male assembly 100 via neutral ball bearings 128 and neutral clips 130. Cylindrical line conductor 132 connects with the line conductor of the power cord, conducting the line current to and from shaft line conductor 134 via line clips 136 and line ball bearings 138. Connections from the various conductors of the male and female assemblies to their respective power cords may be achieved in a variety of ways and are well within the capabilities of one skilled in the art.

Shaft line conductor 134 is characterized at one end by a cone shaped surface 140 and is operable to move along the x-axis. As will be discussed, surface 140 is inserted into receptacle 112 when the male and female assemblies are connected. It will be understood that surface 140 and receptacle 112 may have a variety of contours and remain within the scope of the invention. For example, according to one embodiment, surface 140 has a spherical shape and receptacle 112 is in the shape of a rounded cup which matches the contours of surface 140. In addition, shaft line conductor 134 is enclosed by a spring 142 which causes shaft line conductor 134 to resist force in the negative x-direction, and is secured within female assembly 120 against the force of spring 142 by the action of ball bearings 144 against a raised surface in insulation 122.

A collar 148 encloses a portion of female assembly 120 and is also operable to move along the x-axis. The movement of collar 148 is limited in one direction by ball bearings 150 and in the other by a lip in ground conductor 124. A spring 154 resists movement of collar 148 in the negative x-direction. When collar 148 is disposed as shown in FIG. 1B, it acts on ground ball bearings 156 causing them to extend into receptacle 158. When collar 148 is moved in the negative x-direction, this inward pressure on ball bearings 156 from collar 148 is relieved due to the narrower aspect of collar 148 at its outer edge. Thus, ground ball bearings 156 may retract from receptacle 158 when collar 148 is moved in this manner.

Figure 1C:
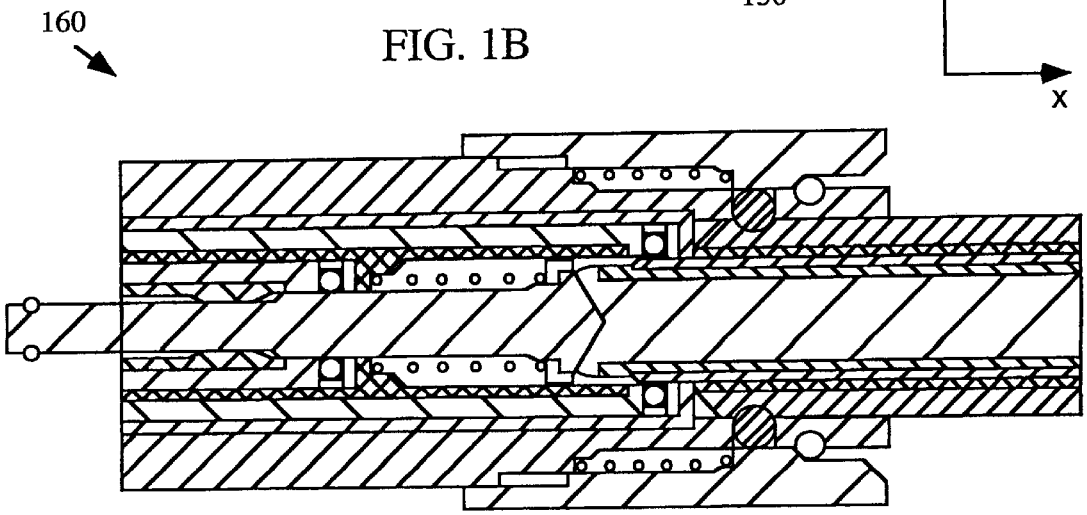
FIG. 1C is a cut-away side view of the male and female assemblies of FIGS. 1A and 1B connected together.

FIG. 1C is a cut-away side view of male assembly 100 inserted into receptacle 158 of female assembly 120 thereby forming swiveling connector 160. The reference numerals in the following discussion have been omitted in FIG. 1C for clarity, but are the same as the corresponding features in FIGS. 1A and 1B. Upon insertion of male assembly into receptacle 158, surface 140 of shaft line conductor 134 is received into and contacts with similarly shaped receptacle 112 of male line conductor 110. Force is exerted against shaft line conductor 134 in the negative x-direction compacting spring 142 which causes shaft line conductor 134 to exert an equal and opposite force against male line conductor 110, thereby maintaining a secure electrical connection between the two. Contact between shaft line conductor 134 and line ball bearings 138 is achieved because the wider aspect of shaft line conductor 134 is disposed adjacent line ball bearings 138 in this position. Thus, the line conduction path is maintained through male line conductor 110, shaft line conductor 134, line ball bearings 138, line clips 136, and cylindrical line conductor 132.

The connection between male and female assemblies 100 and 120 is securely maintained against the force of spring 142 by the interaction of collar 148 and ground ball bearings 156 of female assembly 120 with annular depression 106 of male assembly 100. When male assembly 100 is inserted into receptacle 158 as shown in FIG. 1C, ground ball bearings 156 are forced into annular depression 106 by the action of the thicker portion of collar 148 on ball bearings 156. In this way, a ground conduction path is maintained through male ground conductor 104, ground ball bearings 156 and female ground conductor 124. Moreover, with ball bearings 156 firmly pressed into annular depression 106, male and female assemblies are locked together securely enough to support a considerable amount of weight, thus contributing to work place safety (e.g., falling power tools, momentary support for an off-balance worker, etc.).

The neutral conduction path is maintained through male neutral conductor 108, neutral ball bearings 128, neutral clips 130, and female neutral conductor 126.

To disconnect the assemblies, collar 148 is moved in the negative x-direction thereby positioning the thinner portion of collar 148 adjacent ground ball bearings 156. Male assembly 100 may then be pulled out of female assembly 120 in the positive x-direction with little resistance as ball bearings 156 are able retract out of receptacle 158 and annular depression 106.

Figure 2:
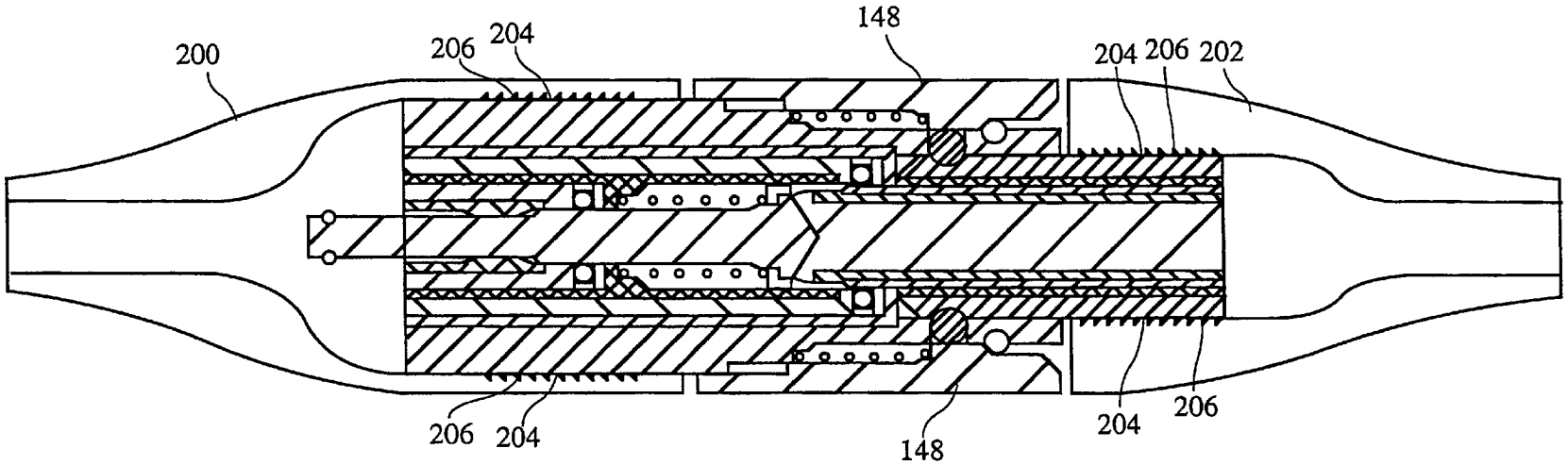
FIG. 2 is a cut-away side view of the connector of FIG. 1C enclosed in a nonconductive sleeve.
Figure 3A:
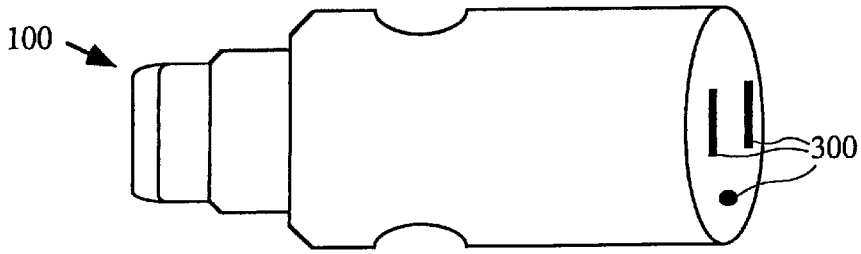
FIG. 3A is a perspective view of the male assembly of FIG. 1A having a three-prong plug termination.
Figure 3B:
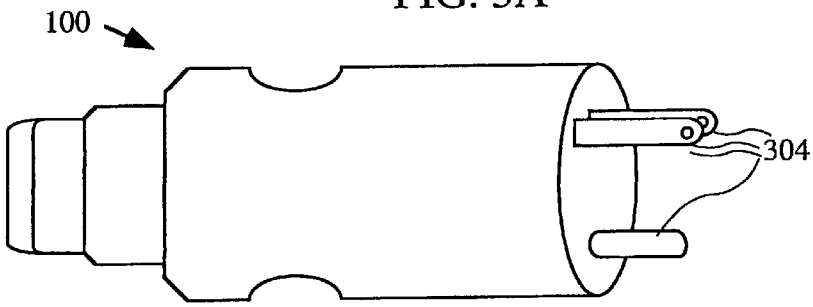
FIG. 3B is a perspective view of the male assembly of FIG. 1A having a three-prong receptacle termination.
Figure 3C:
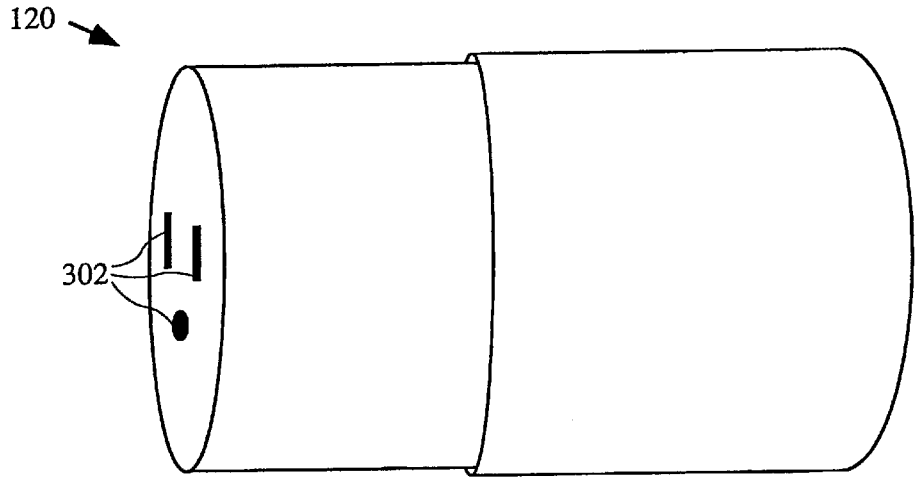
FIG. 3C is a perspective view of the female assembly of FIG. 1B having a three-prong plug termination.
Figure 3D:
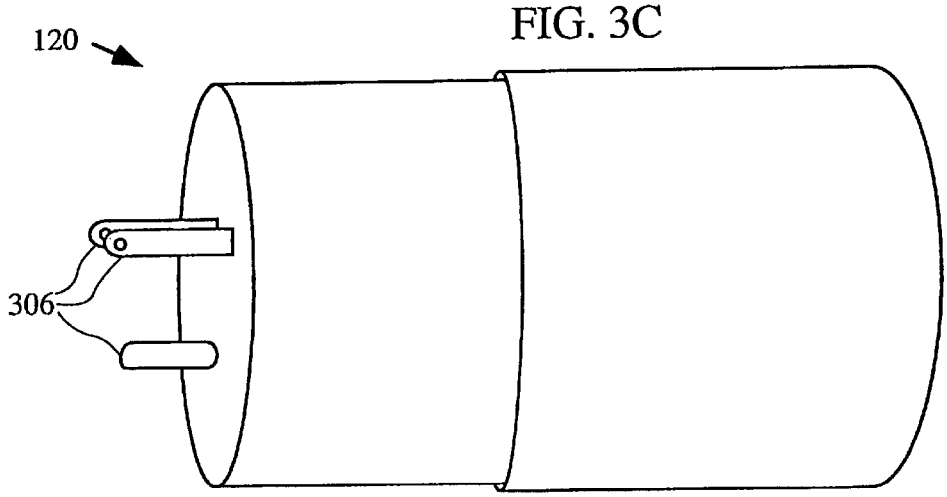
FIG. 3D is a perspective view of the female assembly of FIG. 1B having a three-prong receptacle termination.

FIG. 2 is a cut-away side view of the connector of FIG. 1C partially enclosed in a nonconductive material which gives the assembly a streamlined profile. This configuration reduces the likelihood of the connector snagging on objects when being dragged around a construction site. The profile is formed by collar 148 in conjunction with non-conductive sleeves 200 and 202 which together form a substantially continuous surface as shown in the figure. Moreover, non-conductive sleeves 200 and 202 have threads 204 on their inner surfaces which engage corresponding threads 206 on the exteriors of male and female assemblies 100 and 120. Sleeves 200 and 202 are thus retractable from assemblies 100 and 120 to allow access to the connector for disconnection or maintenance purposes.

FIGS. 3A–3D are perspective views of male and female assemblies 100 and 120 terminated with either a three-prong plug or a three-prong receptacle. Receptacles 300 and 302 (FIGS. 3A and 3C) and prongs 304 and 306 (FIGS. 3B and 3D) allow the present invention to be used with conventional extension cords and connectors, thereby easily and inexpensively modifying any tool or environment to enjoy the benefits and advantages described above. The internal connections between the prongs/receptacles of FIGS. 3A–3D and the respective conductors of the corresponding male and female assemblies are not shown as the implementation of such connections may be done in a variety of ways which are well within the capabilities of one of ordinary skill in the art.

Figure 4:
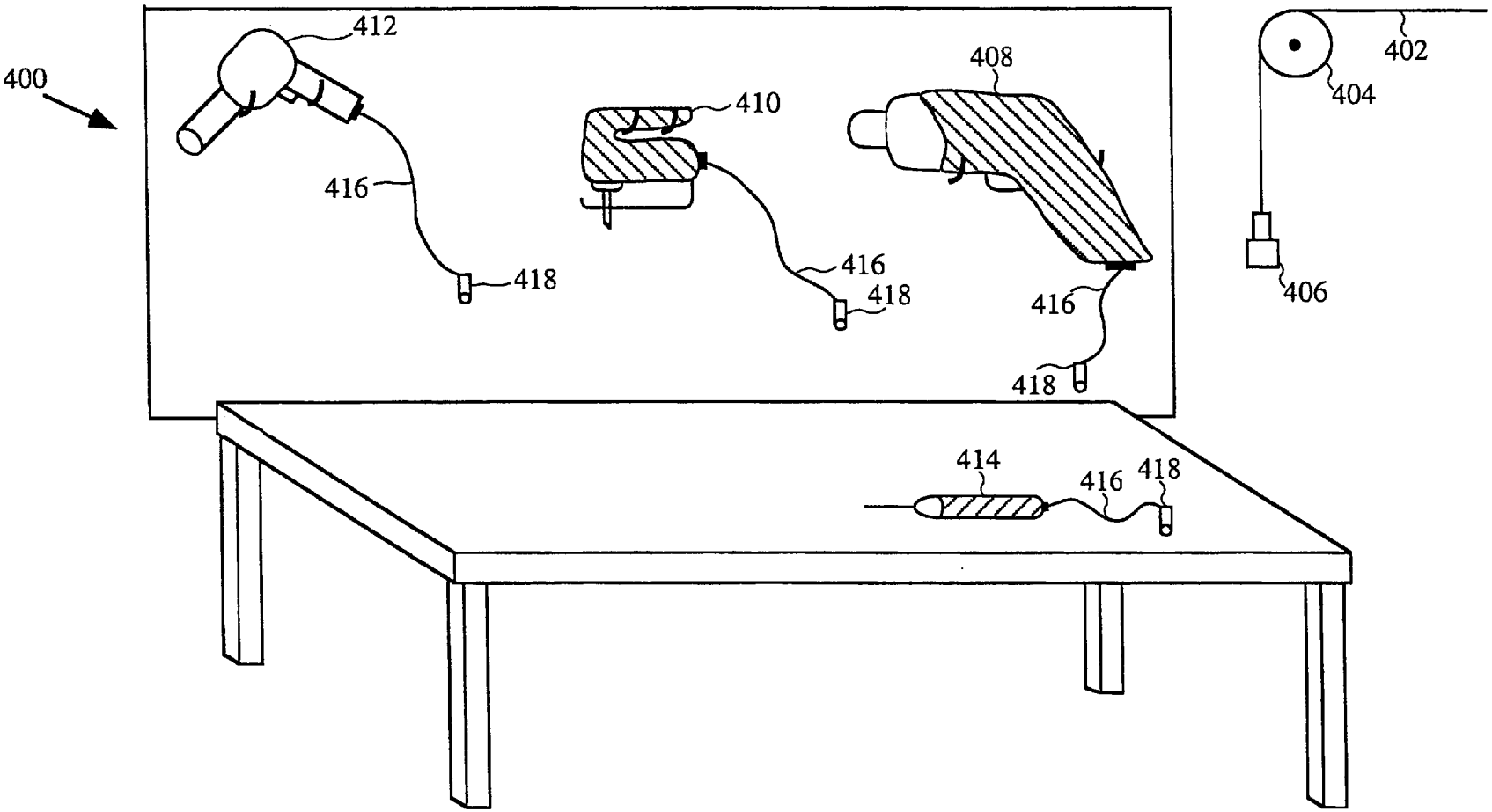
FIG. 4 illustrates the use of a specific embodiment of the invention in a manufacturing environment.

FIG. 4 illustrates the use of a specific embodiment of the invention in a manufacturing environment. Electricity is delivered to a work station 400 via line 402 on a retracting roller system 404. Line 402 is terminated in a female connector assembly 406 designed according to the present invention (e.g., female assembly 120 of FIG. 1B). Work station 400 is equipped with a number of power tools (408–414) each of which has a power cord "tail" 416 terminated in a male connector assembly 418 designed according to the invention (e.g., male assembly 100 of FIG. 1A). The worker may easily switch between the power tools because of the "quick-release" nature of the connection between the male and female assemblies of the present invention. The advantages of such an arrangement are obvious to anyone who has worked in a similar environment. In addition to the efficiencies of time and space realized by such an arrangement, all of the benefits of a freely swiveling electrical connection discussed above are also enjoyed.

Figure 5A:
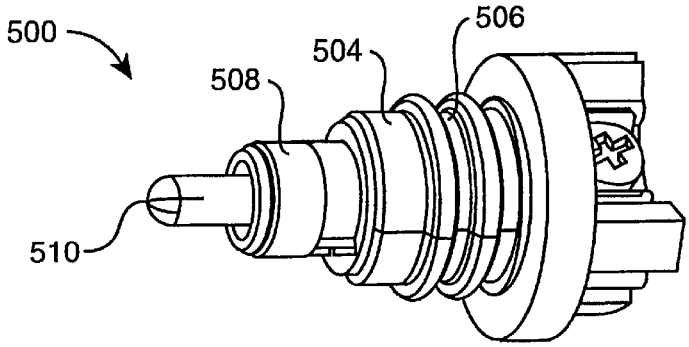
FIG. 5A is a partial section view of a male assembly designed according to a specific embodiment of the invention.
Figure 5B:
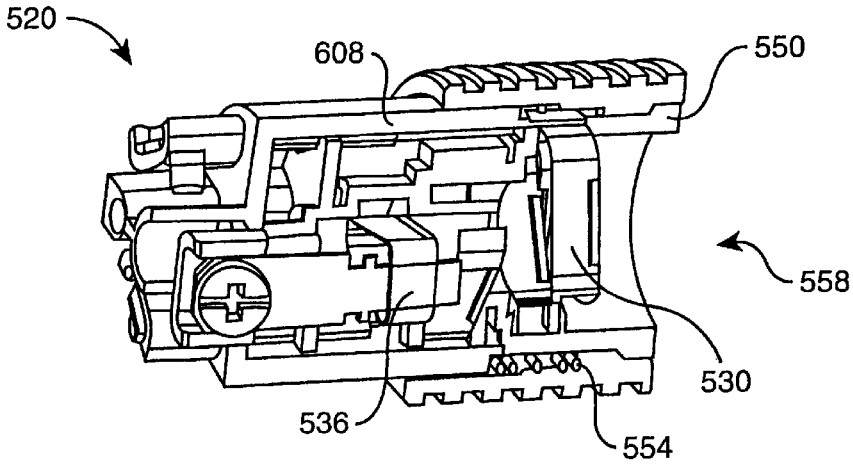
FIG. 5B is a partial section view of a female assembly designed according to a specific embodiment of the invention.
Figure 5C:
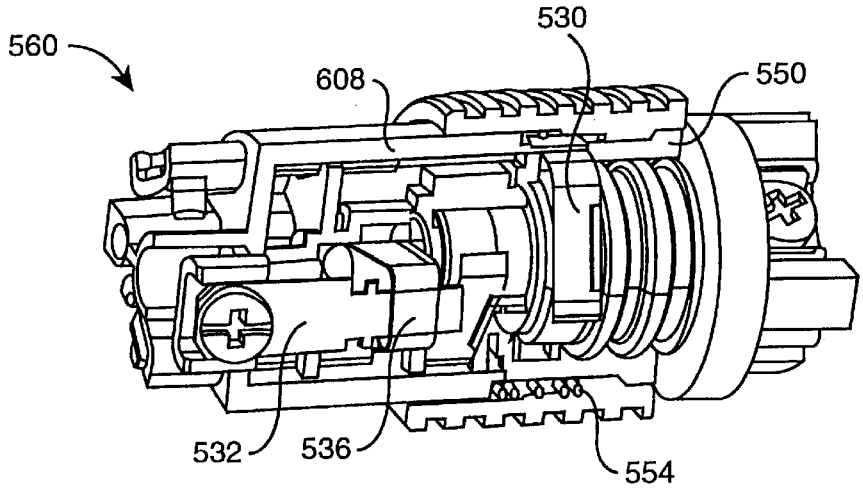
FIG. 5C is a partial section view of the male and female assemblies of FIGS. 1A and 1B connected together.
Figure 5D:
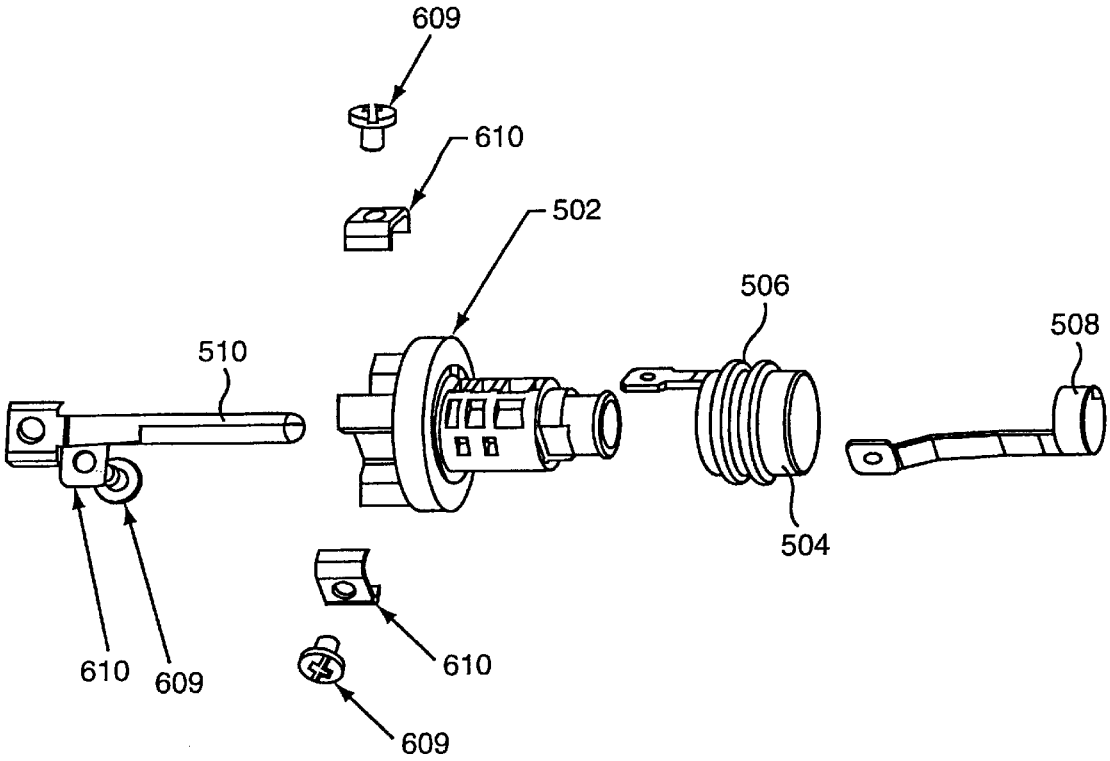
FIGS. 5D and 5E are exploded views of male and female assemblies, respectively.

Another specific embodiment of the invention will now be described with reference to FIGS. 5A–5E and 6. FIG. 5A is a partial section view of a male assembly 500 designed according to a specific embodiment of the invention. FIG. 5B is a partial section view of a female assembly 520 designed according to a specific embodiment of the invention. FIG. 5C is a partial section view of the male and female assemblies of FIGS. 5A and 5B connected together. FIG. 5D is an exploded view of male assembly 500. Male assembly 500 has two conducting bands and one conducting cylinder separated by insulation material 502. Ground conductor 504, the outermost of the conductors, connects with the ground wire of the power cord to which male assembly 500 is connected (not shown). The inner band conductor 508 is a neutral conductor which connects to the power cord's neutral line. Line cylinder conductor 510 connects with the line conductor of the power cord, conducting the line current to and from the female assembly shown in FIG. 5B.

Figure 5E:
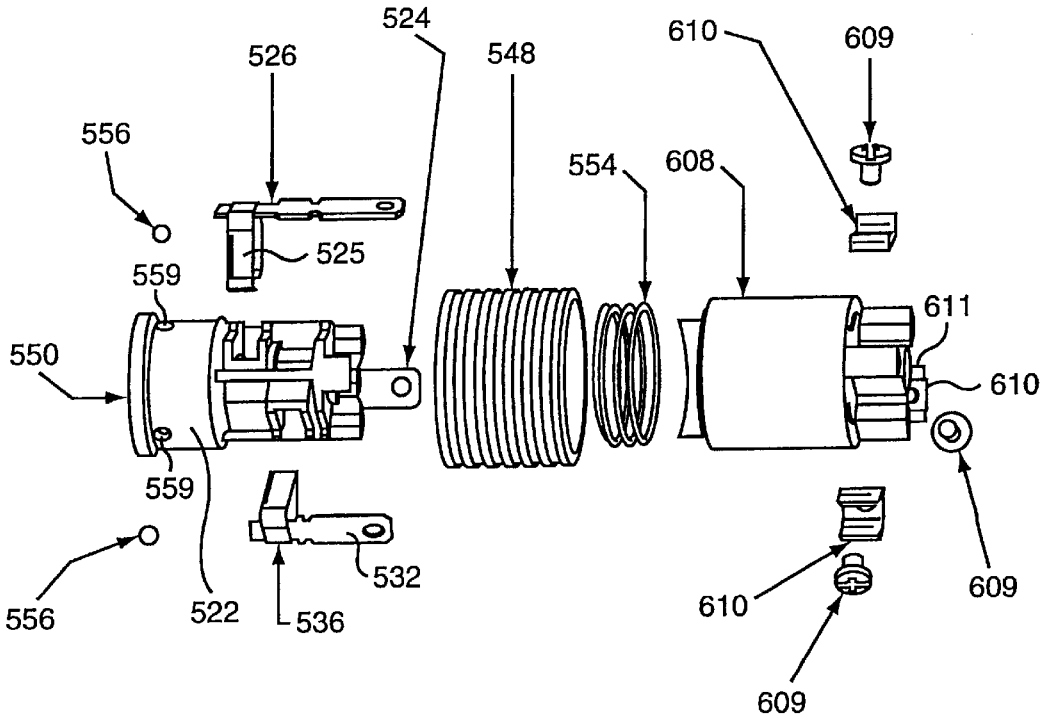

FIG. 5E is an exploded view of a female assembly 520 for connection to male assembly 500 of FIG. 5A. Female assembly 520 has three clip conductors assemblies which are separated by insulation material 522. Ground conductor 524, the outermost of the conductors, connects with the ground wire of the power cord to which female assembly 520 is connected (not shown), and with ground conductor 504 of male assembly 500 via a clip (not shown) similar to clips 525 and 536. Neutral conductor 526, the middle conductor, connects to the power cord's neutral line and to neutral conductor 508 of male assembly 500 via neutral clip 525. Line conductor 532 connects with the line conductor 510 of the power cord, conducting the line current via line clip 536. Connections from the various conductors of the male and female assemblies to their respective power cord wiring may be achieved using conducting plates 610 and screws 609. Female assembly 520 is held together by a screw (not shown) which is inserted into hole 611.

A collar 548 encloses a portion of female assembly 520 and is operable to move along the x-axis. The movement of collar 548 is limited in one direction by lip 550 and in the other by insulating material 608. A spring 554 resists movement of collar 548 in the negative x-direction. When collar 548 is disposed as shown in FIG. 5B, it acts on ball bearings 556 causing them to extend into receptacle 558 via holes 559. When collar 548 is moved in the negative x-direction, this inward pressure on ball bearings 556 from collar 548 is relieved due to the narrower aspect of collar 548 at its outer edge. Thus, ball bearings 556 retract from receptacle 558 back into holes 559 when collar 548 is moved in this manner.

FIG. 5C is a cut-away side view of male assembly 500 inserted into receptacle 558 of female assembly 520 thereby forming swiveling connector 560. The reference numerals in the following discussion have been omitted in FIG. 1C for clarity, but are the same as the corresponding features in FIGS. 5A, 5B, 5D, and 5E. Upon insertion of male assembly 500 into receptacle 558, the line conduction path is maintained through male line cylinder conductor 510, line clip 536, and line conductor 532.

The connection between male and female assemblies 500 and 520 is securely maintained against the force of spring 554 by the interaction of collar 548 and ball bearings 556 of female assembly 520 with annular depression 506 of male assembly 500. When male assembly 500 is inserted into receptacle 558 as shown in FIG. 5C, ball bearings 556 are forced into annular depression 506 through holes 559 by the action of the thicker portion of collar 548 on ball bearings 556. With ball bearings 556 firmly pressed into annular depression 506, male and female assemblies are locked together securely enough to support a considerable amount of weight, thus contributing to work place safety (e.g., falling power tools, momentary support for an off-balance worker, etc.).

The neutral conduction path is maintained through male neutral conductor 508, neutral clip 525, and female neutral conductor 526.

To disconnect the assemblies, collar 548 is moved in the negative x-direction thereby positioning the thinner portion of collar 548 adjacent ball bearings 556. Male assembly 500 may then be pulled out of female assembly 520 in the positive x-direction with little resistance as ball bearings 556 are able retract out of receptacle 558 and annular depression 506.

It will be understood that the embodiments of FIGS. 3A–3D and 4 may be implemented with the embodiment of FIGS. 5A–5E.

Figure 6:
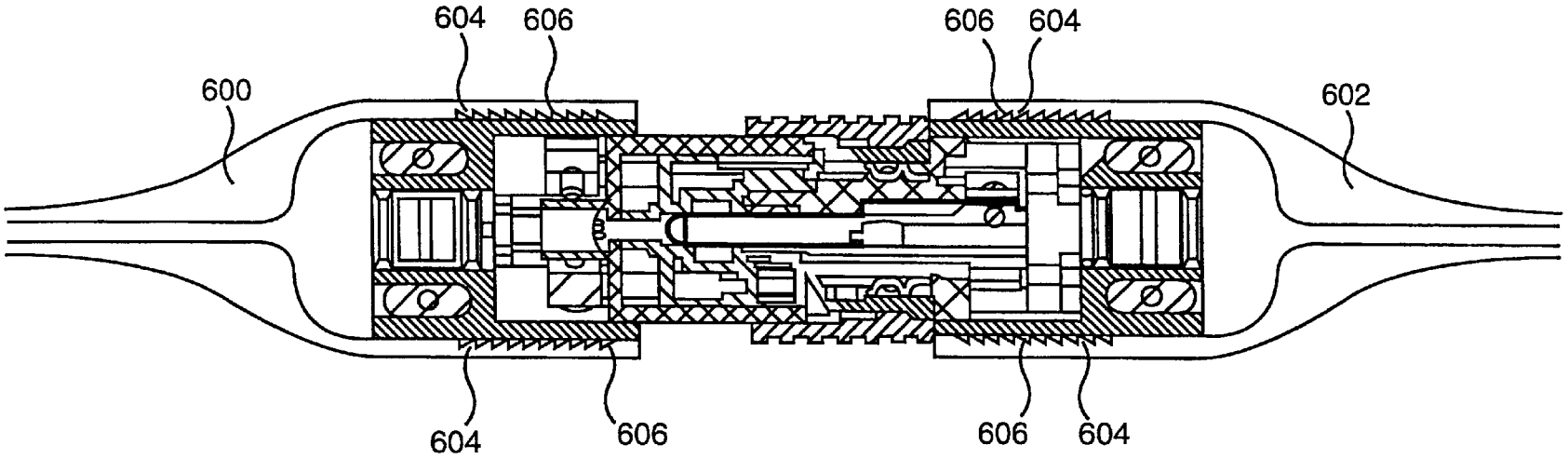
FIG. 6 is a cut-away partial side view of the connector of FIG. 1C enclosed in a nonconductive sleeve.

FIG. 6 is a cut-away side view of the connector of FIG. 5C partially enclosed in a nonconductive material which gives the assembly a streamlined profile. This configuration reduces the likelihood of the connector snagging on objects when being dragged around a construction site. The profile is formed by collar 548 in conjunction with non-conductive sleeves 600 and 602 which together form a substantially continuous surface as shown in the figure. Moreover, non-conductive sleeves 600 and 602 have threads 604 on their inner surfaces which engage corresponding threads 606 on the exteriors of male and female assemblies 500 and 520. Sleeves 600 and 602 are thus retractable from assemblies 500 and 520 to allow access to the connector for disconnection or maintenance purposes.

While the invention has been particularly shown and described with reference to specific embodiments thereof, it will be understood by those skilled in the art that the foregoing and other changes in the form and details may be made therein without departing from the spirit or scope of the invention.

What is claimed is:

1. An electrical connector, comprising:

a male assembly having three conductors electrically isolated from each other, a first one of the three conductors in the male assembly including a cylindrical surface;

a female assembly having three conductors electrically isolated from each other and a receptacle for receiving the male assembly, a first one of the three conductors in the female assembly having a clip assembly extending therefrom for contacting the cylindrical surface of the first conductor in the male assembly; and a locking mechanism coupled to the female assembly for locking the male and female assemblies together when the male assembly is inserted into the female assembly thereby providing electrical contact between the male assembly conductors and the female assembly conductors;

wherein the male and female assemblies rotate relative to each other when locked together, the clip assembly in the female assembly maintaining contact with the first conductor in the male assembly while the male and female assemblies rotate relative to each other.

2. The electrical connector of claim 1 further comprising:

a first sleeve at least partially enclosing the male assembly; and a second sleeve at least partially enclosing the female assembly;

wherein with the first and second sleeves, the electrical connector provides a streamlined profile resistant to snagging on obstacles.

3. The electrical connector of claim 2 wherein the first and second sleeves are threaded and engage corresponding threads on the male and female assemblies thereby allowing the first and second sleeves to be retracted from the male and female assemblies.

4. The electrical connector of claim 1 wherein the male assembly conductors comprise a male line conductor, and the female assembly conductors comprise a female line conductor.

5. The electrical connector of claim 4 wherein the female line conductor comprises the clip assembly and the male line conductor comprises the first conductor in the male assembly.

6. The electrical connector of claim 1 wherein each of the three conductors in the female assembly comprises a clip assembly and each of the three conductors in the male assembly comprises a cylindrical surface for contacting with a corresponding one of the clip assemblies.

7. The electrical connector of claim 1 wherein portions of the male assembly conductors are concentrically disposed about a central axis of the male assembly.

8. The electrical connector of claim 1 wherein the male assembly has an annular depression around its exterior, and the female assembly has a plurality of ball bearings disposed in a ring about the receptacle, the locking mechanism comprising a collar coupled to the female assembly and in contact with the ball bearings, the collar being slidable in a direction parallel to the central axis of the female assembly, wherein, when the male assembly is inserted into the female assembly and the collar is in a first position, the ball bearings are secured in the annular depression thereby locking the male and female assemblies together, and wherein when the collar is in a second position, the ball bearings retract from the annular depression and the male and female assemblies may be separated.

9. The electrical connector of claim 1 wherein the locking mechanism comprises a pneumatic-hose-type locking mechanism.

* * * * *